US011150022B2

(12) United States Patent
Jansen et al.

(10) Patent No.: US 11,150,022 B2
(45) **Date of Patent: *Oct. 19, 2021**

(54) USE OF A HEAT INSULATING MOLDED BODY FOR ISOLATION OF MOLTEN METAL AGAINST THE ATMOSPHERE OR AGAINST A METALLURGICAL VESSEL

(71) Applicant: Refratechnik Holding GmbH, Ismaning (DE)

(72) Inventors: Helge Jansen, Düsseldorf (DE); Thomas Schemmel, Meerbusch (DE); Petra Stein, Göttingen (DE); Michael Schölwer, Velbert (DE)

(73) Assignee: Refratechnik Holding GmbH, Ismaning (DE)

( * ) Notice: Subject to any disclaimer, the term of this patent is extended or adjusted under 35 U.S.C. 154(b) by 16 days.

This patent is subject to a terminal disclaimer.

(21) Appl. No.: 16/313,242

(22) PCT Filed: Jun. 27, 2017

(86) PCT No.: PCT/EP2017/065921
§ 371 (c)(1),
(2) Date: Dec. 26, 2018

(87) PCT Pub. No.: WO2018/002096
PCT Pub. Date: Jan. 4, 2018

(65) Prior Publication Data

US 2019/0154337 A1 May 23, 2019

(30) Foreign Application Priority Data

Jun. 30, 2016 (DE) ..... 10 2016 112 044.8

(51) Int. Cl.
*F27D 1/00* (2006.01)
*B22D 7/10* (2006.01)
(Continued)

(52) U.S. Cl.
CPC ..... *F27D 1/0006* (2013.01); *B22D 7/10* (2013.01); *B22D 11/10* (2013.01); *B22D 11/106* (2013.01);
(Continued)

(58) Field of Classification Search
CPC ..... B22C 1/08; F27D 1/0006; F27D 1/10; B22D 7/10; B22D 41/02; B22D 11/106;
(Continued)

(56) References Cited

U.S. PATENT DOCUMENTS 3,558,591 A * 1/1971 Yendreck et al. ..... B22D 7/10 523/140
9,868,149 B2 1/2018 Recknagel et al.
(Continued)

FOREIGN PATENT DOCUMENTS

CN 102343425 A 2/2012
DE 2847807 A1 * 5/1979 ..... C04B 28/34
(Continued)

OTHER PUBLICATIONS

European Patent Office, Rijswijk, Netherlands, International Search Report of International Application No. PCT/EP2017/065921, dated Aug. 30, 2017, 2 pages.

*Primary Examiner* — Scott R Kastler
(74) *Attorney, Agent, or Firm* — Dickinson Wright PLLC

(57) ABSTRACT

An unfired, refractory molded body (1), includes a binding agent matrix (2) containing at least one set, permanent binding material and aggregate grains (3) with and/or of biogenic silicic acid, preferably with and/or of rice husk ash, which grains are incorporated into the binding agent matrix (2), for thermal isolation of a molten metal, especially of molten steel, and/or of a metal ingot solidifying from the molten metal, and also the use of the molded body (1) for thermal isolation of a refractory lining, in particular in a
(Continued)

multiple-layer brick wall or in a heat-treatment furnace, or as a corrosion barrier, e.g. against alkali attack, or as a fire protection lining or as filter material for hot gases.

24 Claims, 6 Drawing Sheets

(51) Int. Cl.

| | |
|---|---|
| ***B22D 11/106*** | (2006.01) |
| ***B22D 11/11*** | (2006.01) |
| ***B22D 27/06*** | (2006.01) |
| ***F27D 1/10*** | (2006.01) |
| ***B22D 11/10*** | (2006.01) |
| ***B22D 41/02*** | (2006.01) |
| *F27B 14/08* | (2006.01) |
| *F27B 14/10* | (2006.01) |

(52) U.S. Cl.
CPC ..... *B22D 11/11* (2013.01); *B22D 27/06* (2013.01); *B22D 41/02* (2013.01); *F27D 1/10* (2013.01); *F27B 2014/0843* (2013.01); *F27B 2014/104* (2013.01)

(58) Field of Classification Search
CPC .. B22D 11/11; B22D 27/06; F27B 2014/0843
USPC ..... 266/280
See application file for complete search history.

(56) References Cited

U.S. PATENT DOCUMENTS

| | | | | |
|---|---|---|---|---|
| 2014/0235750 | A1* | 8/2014 | Recknagel | C04B 18/101 523/142 |
| 2014/0352910 | A1 | 12/2014 | Kloskowski et al. | |
| 2016/0129496 | A1 | 5/2016 | Stötzel et al. | |

FOREIGN PATENT DOCUMENTS

| | | | | |
|---|---|---|---|---|
| DE | 2847807 | A1 | 5/1979 | |
| DE | 3020681 | A1 | 3/1981 | |
| DE | 2948162 | A1 | 6/1981 | |
| DE | 3816715 | A1 | 11/1989 | |
| DE | 69101999 | T2 | 9/1994 | |
| DE | 19731653 | A1 | 1/1999 | |
| DE | 19728368 | C1 | 3/1999 | |
| DE | 19809590 | A1 | 9/1999 | |
| DE | 10105620 | A1 | 9/2002 | |
| DE | 102008047601 | B3 | 4/2010 | |
| DE | 102013000527 | A1 | 7/2014 | |
| EP | 0055953 | A1 | 7/1982 | |
| EP | 1728571 | A1 | 12/2006 | |
| GB | 2112374 | A | 7/1983 | |
| GB | 2347143 | | 8/2000 | |
| JP | S57202950 | A | 12/1982 | |
| RU | 2369463 | C1 | 10/2009 | |
| SU | 1397159 | A1 | 6/1988 | |
| WO | WO-2004085334 | A1 * | 10/2004 | C04B 35/14 |

* cited by examiner

USE OF A HEAT INSULATING MOLDED BODY FOR ISOLATION OF MOLTEN METAL AGAINST THE ATMOSPHERE OR AGAINST A METALLURGICAL VESSEL

CROSS-REFERENCE TO RELATED APPLICATIONS

This application is a 35 U.S.C. § 371 national phase application of International Application No.: PCT/EP2017/065921, filed Jun. 27, 2017, which claims the benefit of priority under 35 U.S.C. § 119 to German Patent Application No.: 10 2016 112 044.8, filed Jun. 30, 2016, the contents of which are incorporated herein by reference in their entirety.

FIELD

The present invention relates to the use of a thermally insulating, unfired, refractory molded body, in particular of a plate, for thermal isolation of molten metal, especially of molten steel, and/or of a metallic ingot against the surrounding atmosphere or against a metallurgical vessel, especially in the production of steel in steel mills. The present disclosure in particular relates to the use of a heat insulating covering plate for covering of molten metal, in particular of molten steel, and/or for covering of a solidifying ingot which are located in a metallurgical vessel.

BACKGROUND

The statements in this section merely provide background information related to the present disclosure and several definitions for terms used in the present disclosure and may not constitute prior art.

In metallurgy it is common to cover the free surface of the molten metal, in particular the molten steel, located in an open metallurgical vessel, with a covering material. The covering material forms a protective and heat insulating layer. Firstly, it shields the molten metal bath from atmospheric gases in order to prevent undesirable chemical reactions of the molten metal. Secondly, it is used for isolation or for thermal insulation, respectively, against the atmosphere. Thus the covering material ensures a good surface quality.

As covering material, usually loose bulk material made of refractory materials is used, in particular materials made from rice husk ash. Rice husk ash is produced in large quantities in many rice-producing countries. It is produced as a byproduct of the combustion of rice husk (spelt). When this material is burned, rice husk ash is produced which is chemically very pure and is composed 94-96% of amorphous $SiO_2$. Rice husk ash is thus also called biogenic silicic acid. It has a very high melting point of about 1,650° C. In its production, the volatile constituents burn off, but a unique, microporous structure of the $SiO_2$ is retained. From this structure there results both an extremely low thermal conductivity and also a low bulk weight of the rice husk ash. Consequently, rice husk ash does indeed have an outstanding thermal insulation, however, due to its great fineness, in particular when applied onto the surface of the molten metal, it causes a significant generation of dust which can be hazardous to health, e.g. can cause eye injury. This is because the minute dust particles can move into the human body. Therefore, ventilation equipment, for example, has to be installed, which in turn, owing to the suctioning of the rice husk ash, can result in loss of material.

For this reason it is also known in the prior art, to use granulates as covering material, instead of the pure rice husk ash. These granulates consist of granulated refractory materials which are solidified by means of a binding material. Granulates of this kind are known, for example, from DE 10 2013 000 527 A1, DE 197 28 368 C1 and DE 197 31 653 C2.

The granulates in DE 10 2013 000 527 A1 contain primarily and preferably up to 90 wt % of kieselguhr. As binding material, for example, bentonite, water-glass or cellulose is used. Also, the granules can contain polyvinyl polypyrrolidone as binding material. The granulate itself melts after a certain amount of time.

The granulate known from DE 197 28 368 C1 comprises granules which are produced from rice husk ash, an organic, gel-forming binding material in quantities from 1 to 10 wt %, and water in quantities from 20 to 100 wt %.

The beads/pellets of the granulate known from DE 197 31 653 C2 consist of rice husk ash which is mixed with a surface-active substance and a binding material. The surface-active substance can be sodium alginate, a sodium salt of carboxymethyl cellulose, sodium hexametaphosphate or mixtures thereof. With regard to the binding material, it can be polyvinyl alcohol, molasses, sodium hexametaphosphate, Portland cement, sodium silicate and precipitated calcium carbonate and mixtures thereof. The beads/pellets after mixing and compaction, are dried and then fired at a temperature of 800-1400° C.

The granulates do indeed result in a significantly reduced dust pollution in comparison to pure rice husk ash. But they also comprise a greater bulk weight and thus provide a poorer insulation. In addition, due to their manufacture they are also considerably more expensive than bulk material made of pure rice husk ash.

The metallurgical vessels to be covered pertain in particular to casting distributors, preferably to a continuous casting distributor (tundish), a steel ladle or to an ingot mold for rising or falling ingot casting. In ingot casting, the liquid metal is filled into a standing mold (ingot mold) and solidifies therein. The mold can be filled either from above (falling ingot casting), or also from below (rising ingot casting) through an feeding system. After solidifying, the ingot mold is stripped off, that is, it is removed from the solidified metal and the ingot is further processed.

While the molten steel is solidifying in the ingot mold, shrinkage cavities (pits) can form especially in the ingot head. Constituents with a relatively low melting temperature are driven upward before the crystallization front of higher melting point constituents. Therefore, and due to the flow of ascending gas bubbles, elements such as sulfur, phosphorus and carbon can become concentrated in the ingot head. The result is what is known as ingot segregation. Due to the aggraded slags, the result will be "collapse of the head." Therefore the affected, upper region of the ingot must be removed before subsequent processing.

Due to a good thermal isolation of the ingot head, the molten metal in the ingot head can be kept liquid longer and solidifies more slowly. The ingot becomes dense throughout and the portion to be removed remains relatively small. Therefore, isolation of the head in ingot casting is particularly important.

In the case of the rising ingot casting in the production of steel, for isolation of the ingot head, usually first a retaining plate or a metal rod is set onto the ingot mold. The retaining plate usually consists of heat-supplying materials (called "exothermal plate") of mixtures of various, refractory oxides with metal powder, and frequently fluoride-containing components. A bag of casting powder is attached to the retaining plate or the metal rod, by means of a cord. After a short time, the bag burns up due to the high heat of the molten steel, so that the casting powder is distributed onto the molten steel and acts as a separating and lubricating agent between the ingot mold and the steel bath. Next, the retaining plate or the metal rod is removed and the particular bulk material is manually poured as covering material onto the surface of the molten metal. This method is very cumbersome and due to the immediate proximity to the hot ingot mold, it is dangerous to the performing personnel.

Additionally, it is known from the prior art to minimize the pits in the head of the ingot by using a ring-shaped isolating hood (called the "casting hood"). The isolating hood is a separate component and is arranged at the upper end of the ingot mold and/or at the ingot mold head and is installed therein. It thus isolates the ingot mold head from the molten steel in the region of the ingot head. The isolating hood can be designed as a single-part component or can consist of several mutually connected plates. The single-part isolating hoods and the plates usually consist of thermally isolating material.

SUMMARY

The object of the present disclosure is to provide a heat-insulating molded body, in particular a heat-insulating plate, which is used for thermal isolation of molten metal, in particular of molten steel, against the surrounding atmosphere and/or against a metallurgical vessel, in particular in the production of steel, wherein the molded body is to be simple and low in cost to manufacture, shall ensure a good thermal insulation and shall be neither a health hazard nor environmentally harmful.

The object is attained by the use of a molded body, preferably of a plate. The use of an unfired, refractory molded body (1), comprises a binding agent matrix (2) containing at least one set, permanent binding material and aggregate grains (3) with and/or of biogenic silicic acid, preferably with and/or of rice husk ash, which grains are incorporated into the binding agent matrix (2), for thermal isolation of a molten metal, especially of molten steel, and/or of a metal ingot solidifying from the molten metal, and also the use of the molded body (1) for thermal isolation of a refractory lining, in particular in a multiple-layer brick wall or in a heat-treatment furnace, or as a corrosion barrier, e.g. against alkali attack, or as a fire protection lining or as filter material for hot gases.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will be explained in greater detail below, based on the figures. The figures show.

Figure 1:
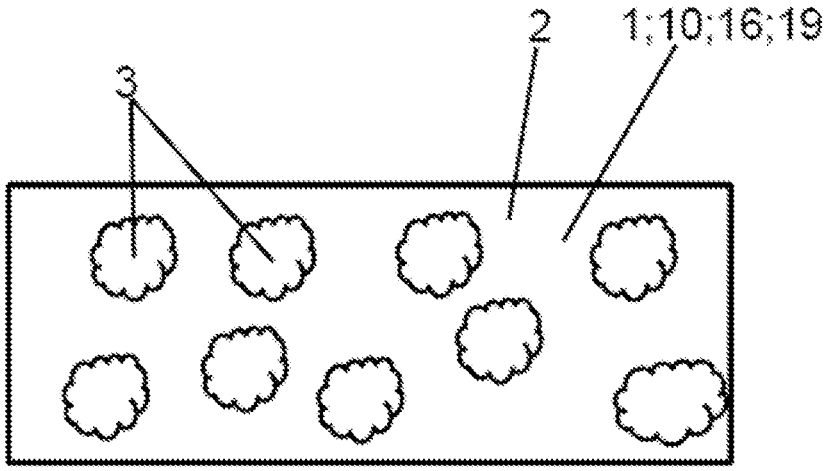
FIG. 1—A schematic cross section through the plate used according to the present disclosure.

The drawings are provided herewith for purely illustrative purposes and are not intended to limit the scope of the present invention.

DETAILED DESCRIPTION

The following description is merely exemplary in nature and is in no way intended to limit the present disclosure or its application or uses. It should be understood that throughout the description, corresponding reference numerals indicate like or corresponding parts and features.

The unfired molded body 1 (FIGS. 1-6) used according to the present disclosure comprises a matrix 2 of at least one set binding material in which aggregate grains 3 of biogenic silicic acid, preferably of rice husk ash, are embedded or incorporated. The aggregate grains 3 are distributed in the binding agent matrix 2. The binding material is a permanent binding material. The permanent binding material is a binding material which hardens below the temperature for the ceramic firing, but under temperature stress, especially in an $O_2$ atmosphere, does not evaporate, but rather is converted and forms a binding matrix with a ceramic or another binding. Permanent binding materials thus ensure the cohesion of the unfired molded body 1 at room temperature and also when used under temperature stress, in particular in an O2 atmosphere. In contrast thereto, a temporary binding material under a temperature stress burns off and evaporates. Permanent binding materials harden, for example, hydraulically or chemically (inorganic or organic-inorganic) or organically at a temperature below the temperature for the ceramic firing, e.g., at room temperature. Under a temperature stress, they form a direct ceramic bond, for example, due to sintering. Phosphate bonds and cement bonds are converted under temperature stress, for example, but remain in place.

Preferably the permanent binding material pertains to an inorganic binding material, preferably to water-glass or a sol-gel binder, or a phosphate binder or alumina cement or Portland cement.

Of course, the binding agent matrix 2 can also consist of several permanent binding materials. Thus, in a particularly advantageous manner, certain properties of the molded body 1 can be adjusted.

Also, the binding agent matrix 2 can additionally comprise at least one set, temporary binding material. But preferably the binding agent matrix 2 consists exclusively of one or a plurality of permanently set binding materials. Thus, it is a permanent binding agent matrix 2.

The biogenic silicic acid pertains preferably exclusively to rice husk ash. But also diatomaceous earth (kieselguhr) and/or siliceous rock and/or diagenetic radiolarian taxa solidified into stone and/or sponges made of opal can be used. Also, mixtures of different biogenic silicic acids can also be present as aggregate material.

Furthermore, the molded body 1 can also comprise other aggregate materials made of refractory material. Aggregate materials within the meaning of the present disclosure are generally materials that and/or whose grains are distributed in the binding agent matrix 2 and are bonded or embedded in it. During the setting process the aggregate materials do not react, or react only superficially with the binding material. The aggregate grains are thus incorporated essentially mechanically into the binding agent matrix 2.

In particular, the molded body 1 comprises microsilica, preferably pyrogenic and/or precipitated silicic acid, as aggregate material. The molded body 1 can also comprise expanded perlite and/or expanded vermiculite and/or expanded clay and/or inorganic fibers, preferably mineral and/or slag and/or glass and/or ceramic fibers, and/or fly ashes and/or (power plant) filter dusts as aggregate material.

Microsilica, fly ashes and/or (power plant) filter dusts can also react and form the binding agent matrix, depending on whether any reaction partners are present in the mixture. In this case, they are not counted among the aggregate materials, but to the binding agent.

Advantageously the aggregate of the molded body 1 consists at least 50 wt %, preferably at least 80 wt %, particularly preferably at least 90 wt % of biogenic silicic acid, preferably of rice husk ash, respectively relative to the total content (dry mass) of aggregate materials. Advantageously the molded body 1 consists exclusively of biogenic silicic acid, preferably exclusively of rice husk ash as aggregate material. The aggregate of the molded body 1 thus consists advantageously 100 wt % of biogenic silicic acid, preferably 100 wt % of rice husk ash.

The production of the molded body 1 according to the present disclosure proceeds as follows. First, the dry constituents are mixed together. The dry constituents pertain to the biogenic silicic acid and the other aggregate materials, if any, and also if used, at least one permanent binding agent if it is present in dry form. Next, water or another liquid solvent is added to the dry mixture to dissolve or to disperse or to activate the binding agent. At least one permanent binding agent can also be provided in already dissolved or dispersed form, and can be added in liquid form to the dry mixture of the other dry ingredients.

The composition of the finished mixture is then adjusted advantageously such that the mixture after 30 s under vibration exhibits a slump, determined with reference to DIN EN ISO 1927-4 (03/2013), of 200 to 500 mm, preferably 250 to 350 mm, without any separation occurring between coarse and fine grain fractions, as is the case for pure rice husk ash.

Advantageously the finished mixture, or the finished batch used to produce the molded body 1 has the following composition with regard to the dry constituents relative to the total dry mass, wherein the individual constituents add up to 100 wt %:

| | Amount [wt %] | |
|---|---|---|
| | | preferably |
| Biogenic silicic acid, | 20.0 to 95.0 | 45.0 to 90.0 |
| Permanent binding agent | 5.0 to 30.0 | 10.0 to 20.0 |
| Other aggregate materials | 0 to 20.0 | 0 to 10.0 |
| Other constituents | 0 to 30.0 | 0 to 25.0 |

Furthermore, the weight ratio of the liquid solvent, preferably of the water, to the dry constituents amounts to preferably 2:1 to 1:9, more preferably 1:1 to 3:7.

The used rice husk ash additionally comprises preferably the following chemical composition according to DIN EN ISO 12677 (February 2013), wherein the individual constituents (free of ignition loss) add up to 100 wt %:

| | Amount [wt %] | |
|---|---|---|
| | | preferably |
| $SiO_2$ | 92 to 98 | 94 to 97 |
| $P_2O_5$ | 0.5 to 2.0 | 0.5 to 1.5 |
| $K_2O$ | 1.0 to 3.0 | 1.5 to 2.5 |
| Residual oxides | 0.5 to 3.0 | 1.0 to 2.0 |

The used biogenic silicic acid, in particular the rice husk ash, also comprises preferably the following grain distribution according to DIN 66165-2 (April 1987) relative to dry mass, wherein the individual constituents add up to 100 wt-%:

| | Amount [wt %] | |
|---|---|---|
| Grain size [mm] | | preferably |
| ≥2.0 | 0 to 3.0 | 0.01 to 0.5 |
| <2.0-1.0 | 0.05 to 4.0 | 0.1 to 2.0 |
| <1.0-0.5 | 1.0 to 40.0 | 1.5 to 35.0 |
| <0.5-0.3 | 3.95 to 40.0 | 8.39 to 30.0 |
| <0.3 | 30.0 to 95.0 | 40.0 to 90.0 |

The bulk weight according to DIN EN 1097-3 (June 1998) of the used biogenic silicic acid, in particular of the rice husk ash, advantageously amounts to 0.05 to 0.5 g/cm$^3$, preferably 0.1 to 0.4 g/cm$^3$.

The finished mixture is then placed into a mold and is compacted therein. The compacting takes place in particular by means of superimposed load vibration or uniaxial pressing.

For the superimposed load vibration the mold is placed on a vibration table. A weight is placed onto the finished mixture located in the mold, then the vibration table is activated and the mixture is compacted by means of the vibration. With the superimposed load vibration method, generally smaller format sizes are produced.

With uniaxial pressing, the mold filled with the finished mixture is placed into a press, wherein a covering plate is placed atop the mixture. Then the upper stamp of the press is moved against the covering plate and the mixture is compacted under a specific pressure. Preferably several press strokes are run. By means of uniaxial pressing, generally larger format sizes are produced.

After the compacting, the green molded body is removed from the mold and allowed to set. The temperature for the setting is selected such that the binding agent will set and/or harden. It is below the temperature for the ceramic firing. Thus the molded body 1 according to the present disclosure is not fired. Cement-bonded molded bodies are advantageously allowed to set at room temperature, preferably until the weight is constant. In the case of other binding agents, such as water glass or sol-gel binders, the setting occurs in particular at 110 to 200° C. for preferably 4 to 12 hours. Phosphate-bonded molded bodies are advantageously allowed to set at temperatures from 200 to 500° C. in order to ensure a complete bonding, with release of water, or up to 1000° C. to obtain a water-insoluble bonding.

The molded body 1 used according to the present disclosure then comprises advantageously a dry apparent density $\rho_0$ of 0.3 to 1.5 g/cm$^3$, preferably from 0.5 to 1.3 g/cm$^3$ according to DIN EN 1094-4 (September 1995).

In addition, the molded body 1 comprises advantageously a porosity from 60 to 90%, preferably from 70 to 80% according to DIN EN 1094-4 (September 1995).

The cold compression strength of the molded body 1 is advantageously at 1.5 to 20.0 MPa, preferably at 2.5 to 15.0 MPa according to DIN EN 993-5 (December 1998).

And the cold flexural strength of the molded body 1 advantageously amounts to 1.0 to 9.0 MPa, preferably 1.5 to 7.0 MPa according to DIN EN 993-6 (April 1995).

The hot flexural strength of the molded body 1 advantageously amounts to 1.5 to 7.0 MPa, preferably 2.0 to 5.0 MPa according to DIN EN 993-7 (April 1995).

In addition, the molded body 1 comprises a softening point from 800 to 1700° C., preferably 1200 to 1650° C., determined with a hot stage microscope according to DIN EN 51730 (September 2007). Thus the molded body 1 is suitable for long-term or permanent use at very high temperatures.

In addition, the molded body 1 comprises preferably the following thermal conductivities according to DIN EN 993-15 (July 2005).

| | Thermal Conductivity [W/mK] | |
|---|---|---|
| | | preferably |
| at 26° C. | 0.10 to 0.14 | 0.11 to 0.13 |
| at 307° C. | 0.12 to 0.16 | 0.13 to 0.15 |
| at 700° C. | 0.17 to 0.21 | 0.18 to 0.20 |
| at 995° C. | 0.25 to 0.29 | 0.26 to 0.28 |

The molded body 1 according to the present disclosure additionally comprises preferably the following chemical composition according to DIN EN ISO 12677(February 2013), wherein the individual constituents (free of ignition loss) add up to 100 wt %:

| | Amount [wt %] | |
|---|---|---|
| | | preferably |
| $SiO_2$ | 22.0 to 99.0 | 43.5 to 97.5 |
| $Al_2O_3$ | 0 to 15.0 | 0 to 10.0 |
| $P_2O_5$ | 0.2 to 20.0 | 0.5 to 15.0 |
| CaO | 0 to 20.0 | 0 to 15.0 |
| $K_2O$ | 0.3 to 10.0 | 0.5 to 7.5 |
| $Na_2O$ | 0 to 10.0 | 0.5 to 7.5 |
| Residual | 0.5 to 3.0 | 1.0 to 1.5 |

As was already explained, the molded body 1 according to the present disclosure is used for thermal isolation of a molten metal, in particular of a molten steel, from the environment. Preferably the molded body 1 is used for thermal isolation of the ingot head during rising ingot casting.

A ingot casting apparatus 4 (FIGS. 2 and 3) for the rising ingot casting of metal, in particular steel, usually comprises a lower frame 5 with a casting channel 6 for feeding the molten metal, in particular the steel. In addition, the ingot casting apparatus 4 comprises a tubular ingot mold 7 to accommodate a metal bath 8 made of molten metal. The ingot mold 7 comprises a lower and an upper, open ingot mold end 7*a;b*. The upper ingot mold end 7*b* forms a ingot mold head 9 of the ingot mold 7.

Figure 2:
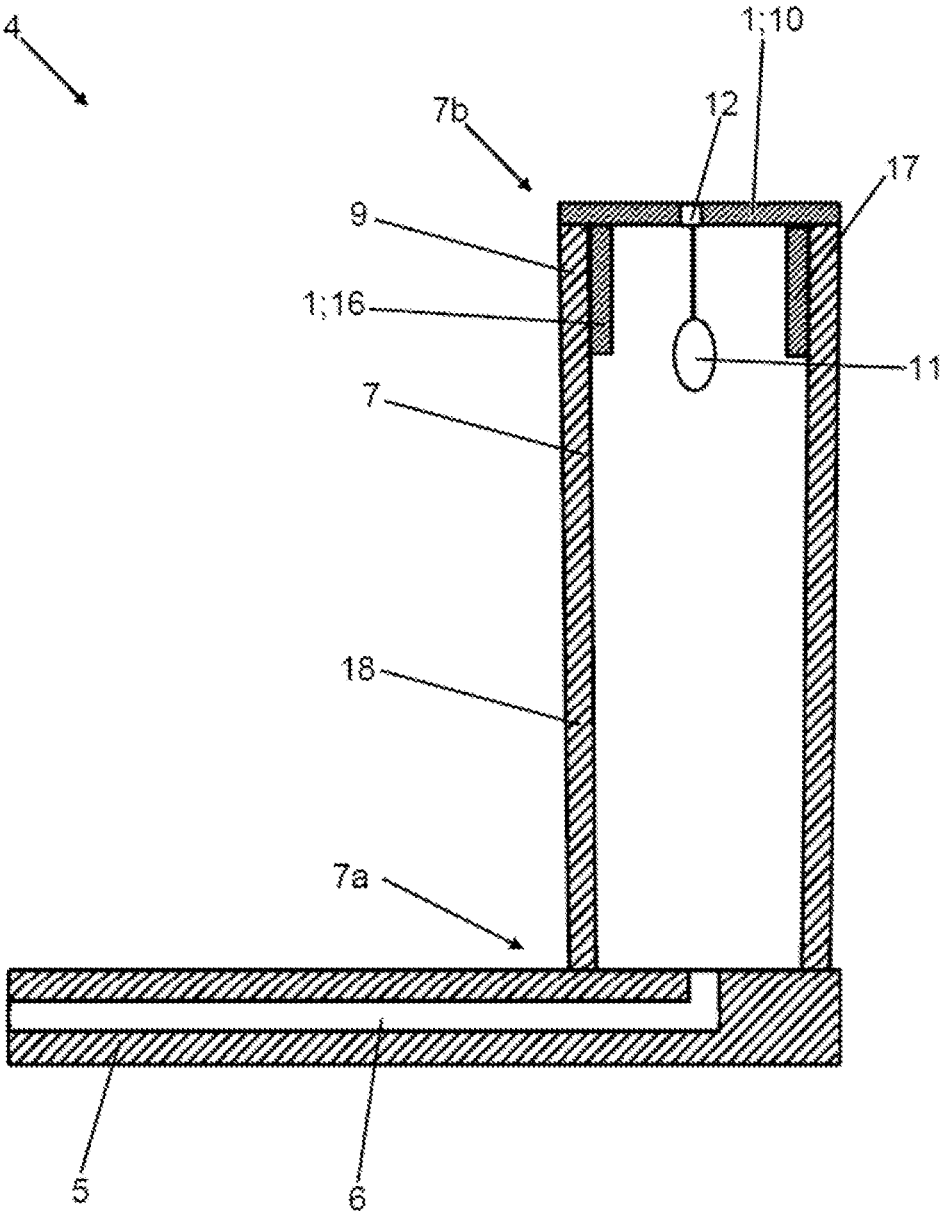
FIG. 2—A schematic and greatly simplified ingot mold for the rising ingot casting before beginning of the casting process with a covering plate.

According to one advantageous feature of the disclosure, the molded body 1 is used as a covering plate 10 for covering of the upper, open ingot mold end 7*b* ingot. The covering plate 10 is placed onto the ingot mold head 9 before beginning of the ingot casting (FIG. 2). Thus the placement onto the ingot mold 7 occurs without direct contact with the metal bath 8. Thus the metal bath 8 is thermally isolated by the covering plate 10 indirectly, thus without direct contact. A casting powder bag 11 filled with casting powder is secured onto the covering plate 10 such that the bag 11 hangs down from the covering plate 10 into the ingot mold 7. To secure the casting powder bag 11 the covering plate 10 comprises preferably a central recess 12 passing from the one plate surface to the other.

Figure 3:
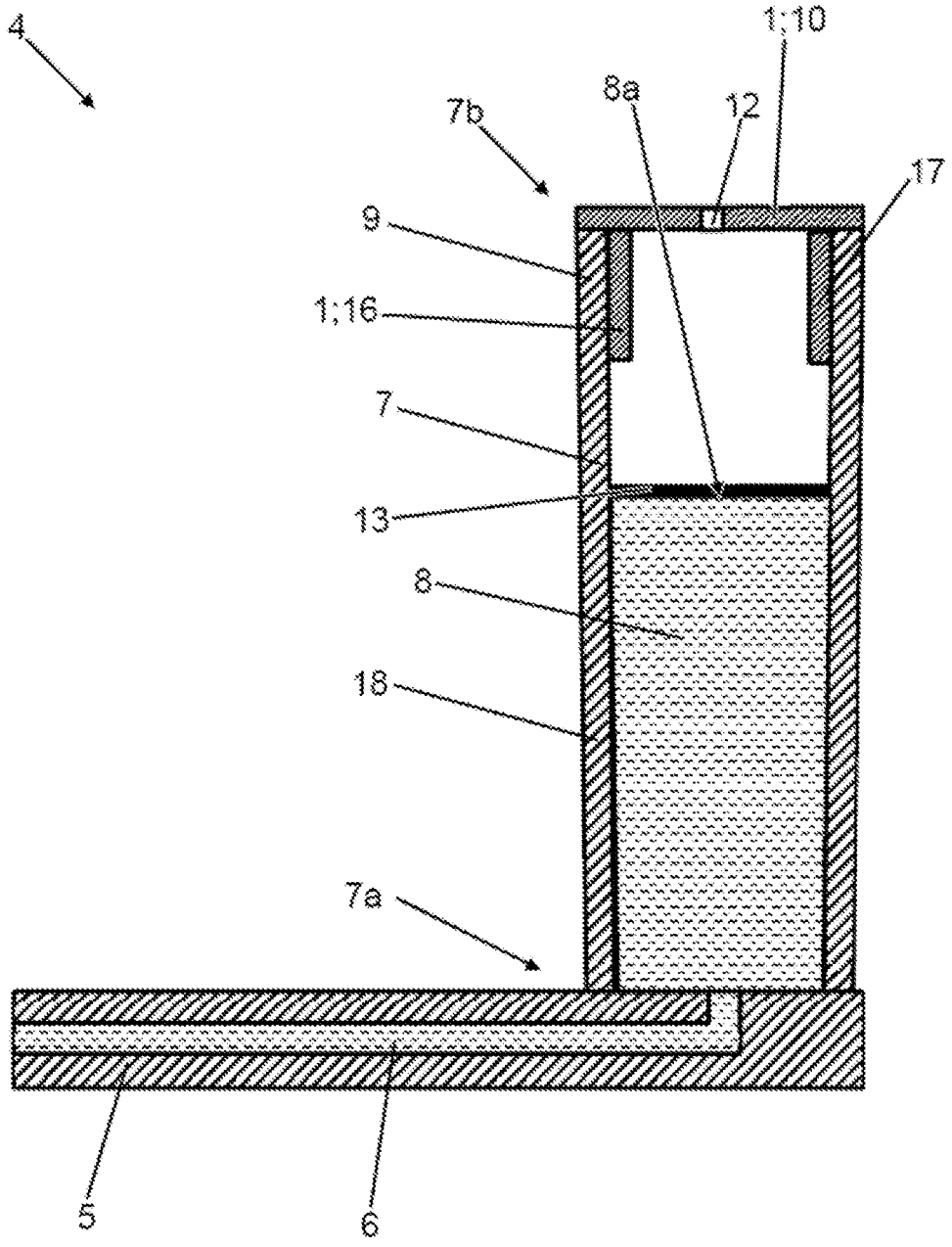
FIG. 3—The ingot mold according to FIG. 2 during the casting process.

Now the molten metal, in particular the molten steel, is filled through the casting channel 6 from below into the ingot mold 7 and rises upward in the mold 7 (FIG. 3). The metal bath 8, in particular the steel bath, usually has a temperature of about 1550° C. The casting powder bag 11 after a short time and owing to the great heat of the molten steel, burns up so that the casting powder is distributed upon a surface 8*a* of the metal bath 8 and forms a superficial casting powder layer 13. In addition, the casting powder is distributed between the ingot mold 7 and the metal bath 8 and acts as a separating and lubricating agent.

Figure 4:
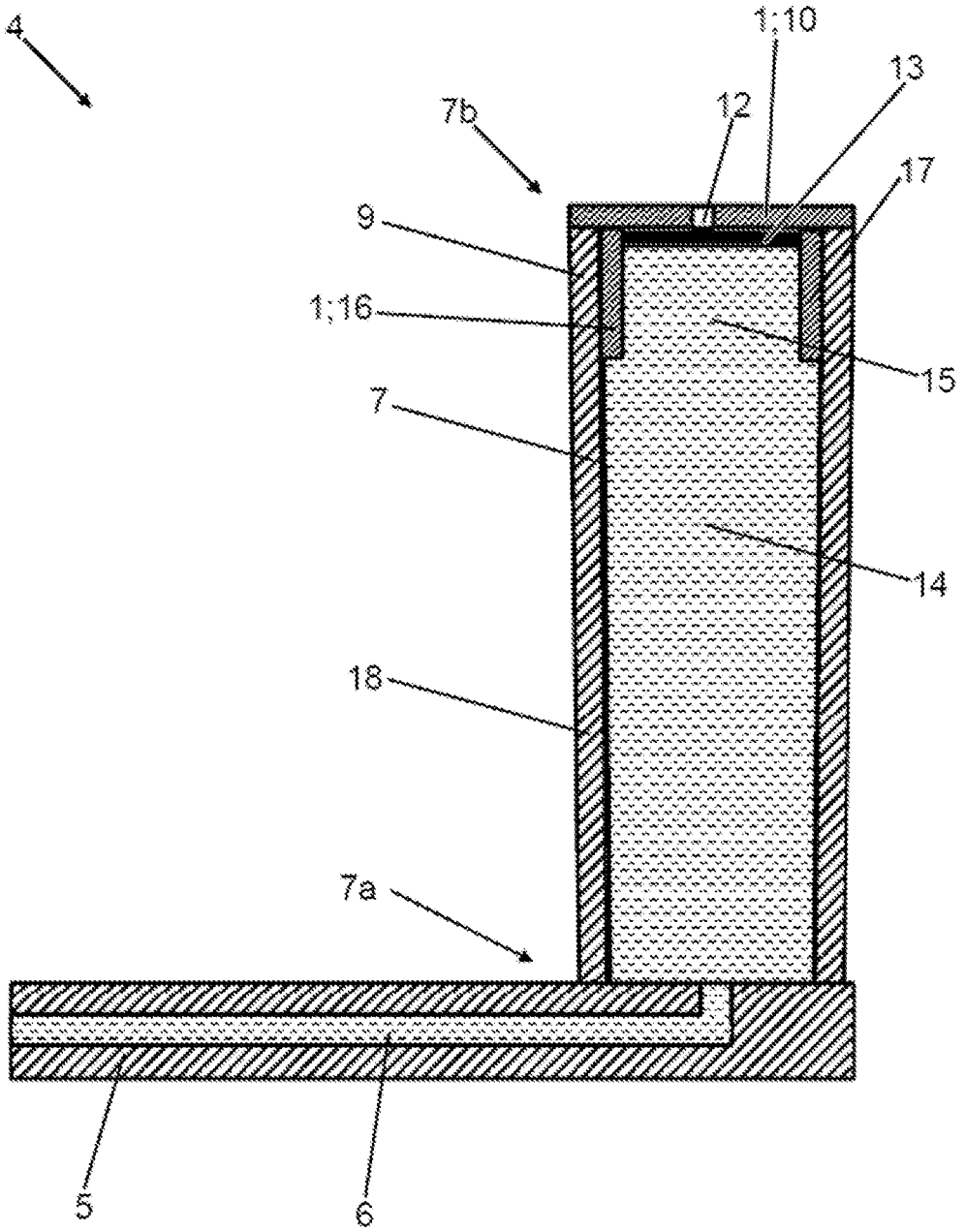
FIG. 4—The ingot mold according to FIG. 2 at the end of the casting process.

The metal bath 8 rises up to the covering plate 10 during the casting and forms a solidifying ingot 14 with an upper ingot head 15 (FIG. 4). The covering plate 10 isolates the ingot head 15 from the atmosphere and thus ensures a slow cooling of the ingot head 15.

According to an additional advantageous aspect of the present disclosure, the molded body 1 is used as isolating plate 16 for a casting hood or isolating hood 17 for thermal isolation of the ingot head 15 from the ingot mold 7, in particular from the ingot mold head 9. The ring-shaped isolating hood 17 consists of several mutually connected isolating plates 16 positioned adjacent to each other in the circumferential direction of the ingot mold 7. It is used for interior lining of the ingot mold head 9. Thus, the isolating hood 17 rests on the inside against the ingot mold wall 18. It can also protrude past the ingot mold 7 (not illustrated) at the ingot mold upper end 7*b*. In this case it is used in particular together with a loose, bulk material, for isolation of the surface 8*a* of the metal bath 8, which is suctioned off at the end of the casting process.

The isolating hood 17 can also be designed as a single piece and thus the molded body 1 is used as an isolating hood 17.

The molded body 1 can be used in an advantageous manner as a covering plate for covering or for isolation of the exposed surface 8*a* of a metal bath in another, open-top metallurgical vessel. In particular, the molded body 1 can be used as covering plate 19 for a casting distributor 20 (FIGS. 5 and 6), preferably for a continuous casting distributor (tundish).

Figure 5:
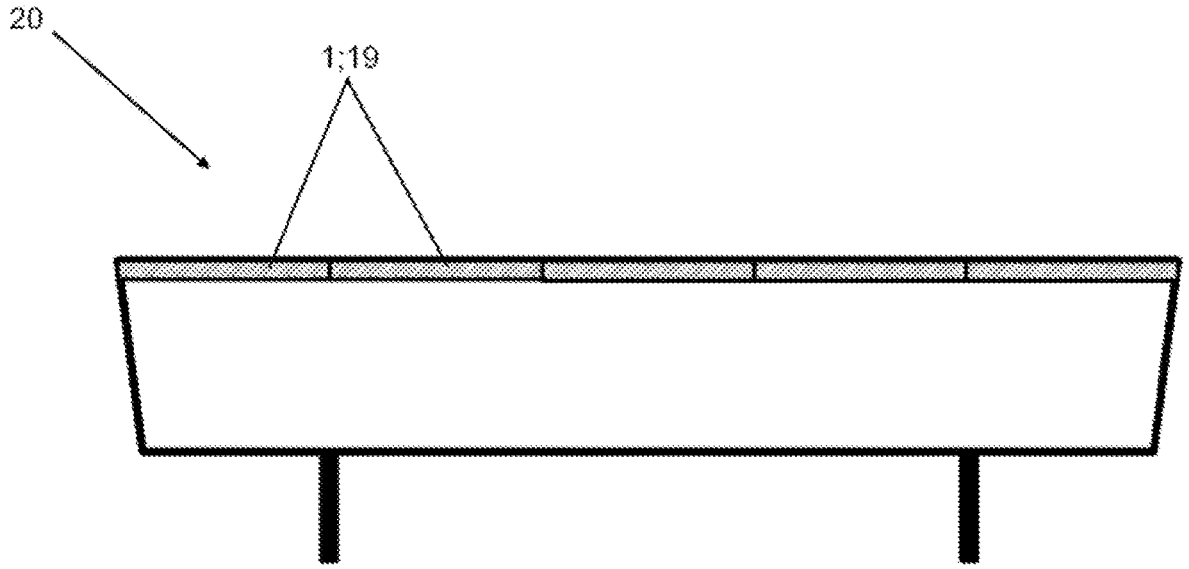
FIG. 5—A schematic and greatly simplified depiction of a tundish before the casting.
Figure 6:
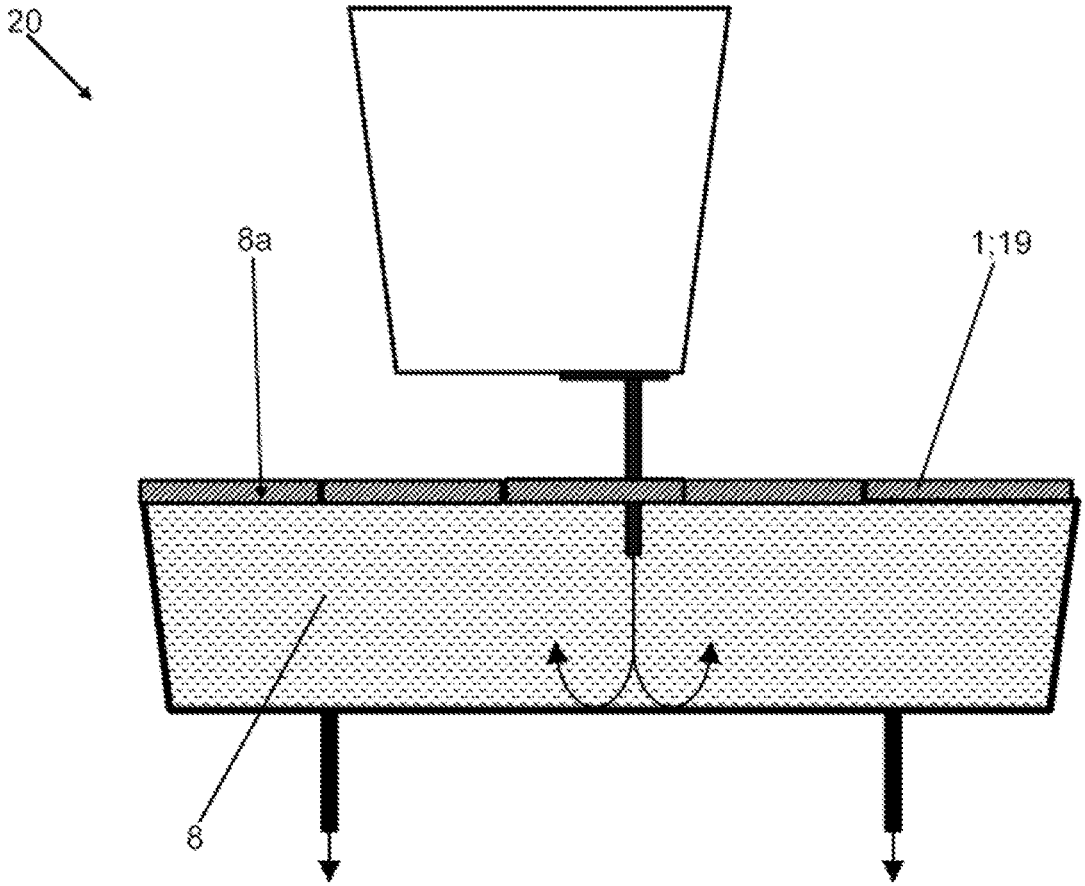
FIG. 6—The casting distributor according to FIG. 5 after the casting.

Before the casting, the casting distributor 20 is advantageously covered with several covering plates 19 (FIG. 5). During the casting, the metal bath 8 rises up to the covering plates 19. They form a solid isolating covering layer that covers the surface 8*a* of the metal bath.

The molded body 1 can also be used in an advantageous manner as a covering plate for covering or for isolation of the exposed surface 8*a* of a metal bath in a casting ladle or in troughs.

In addition, the molded body 1 can also be placed directly onto the surface 8*a* of the metal bath so that it is floating thereon.

Furthermore, the molded body 1 can be used as thermal isolation in a multiple layer brick wall or for refractory linings in heat treatment furnaces or as a corrosion barrier (e.g. against alkali attack) or as a fire protection lining or as filter material for hot gases.

The molded body 1 used according to the present disclosure displays a low thermal conductivity at low temperatures and also at high temperatures, and thus has outstanding thermal insulating properties. When used for isolation of a ingot head in rising ingot casting, this ensures a constant, good quality of the ingot head. The good thermal insulation is a result, in particular, of the very good heat insulating properties of biogenic silicic acid and its very high melting point of about 1650° C.

Furthermore, the molded body 1 is free of pollutants. In addition, the rice husk ash pertains to a natural, recycling product.

When using the covering plate 10 simultaneously as a retaining plate for the casting powder bag 11 and in connection therewith for isolation of the ingot head 15, an additional process step is eliminated. This is because the removal of the retaining plate and subsequent application of the loose rice husk ash is omitted.

In addition, the generation of dust is reduced significantly. Placement of the covering plates 10, 19 onto the ingot mold 7 and/or the casting distributor 20 is additionally much simpler than the placement of a loose, bulk material onto the surface 8*a* of the metal bath 8. In addition, this can occur before filling of the molten metal, which means a much reduced temperature exposure for the particular worker.

It also remains within the scope of the present disclosure to use as aggregate material, a granulate of biogenic silicic acid, in particular of rice husk ash, instead of or in addition to the pure biogenic silicic acid. The granulate grains and/or the aggregate grains in this case consist of agglomerated grains of biogenic silicic acid which are bonded by a set binding agent. But the aggregate grains 3 made of a pure, biogenic silicic acid, in particular of rice husk ash, are preferred.

Also, the production can be advantageously implemented in that the biogenic silicic acid, in particular the rice husk ash, can be granulated with water and/or with at least one binding agent before mixing with the other constituents of the molded body, and the soft and/or ductile, not yet set granulate can be mixed in with the remaining constituents. Preferably the binding agent pertains to the same binding agent and/or the same binding agents which is/are used for the molded body. During compaction or pressing, the ductile granulate grains are destroyed, so that the molded body according to the present disclosure with the aggregate grains of the biogenic silicic acid is formed. The advantage of this variant of the method is that the generation of dust is less.

EXAMPLE

A plate according to the present disclosure was produced from a batch having the following composition, by means of superimposed load vibration:

| | Amount [wt %] |
|---|---|
| Water glass (Betol 52 T) | 50 |
| rice husk ash NERMAT BF - E | 50 |

The final mixture was compacted for 30 s at a frequency of 50 Hz and an amplitude of 0.8 mm. The surface weight of the applied weight amounted to 0.005 N/mm$^2$. The plate was removed from the mold and dried on a tray at 150° C. for 12 h in a drying oven and allowed to set. The plate had the following dimensions: 500×500×300 mm$^3$.

The produced plate had the following properties:

| | |
|---|---|
| Dry apparent density $\rho_0$ (DIN EN 1094-4 (September 1995)) | 0.73 g/cm$^3$ |
| Porosity (DIN EN 1094-4 (September 1995)) | 70.00% |
| Cold compression strength (DIN EN 993-5 (December 1998)) | 4.4 N/mm$^2$ |
| Cold bending strength (DIN EN 993-6 (April 1995)) | 2.4 N/mm$^2$ |

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

While the above description constitutes the preferred embodiments of the present invention, it will be appreciated that the invention is susceptible to modification, variation and change without departing from the proper scope and fair meaning of the accompanying claims.

The invention claimed is:

1. A method of providing thermal isolation of the production of steel, the method comprises providing an unfired, refractory plate (1), the plate (1) including a binding agent matrix (2) containing at least one set, permanent inorganic binding agent and aggregate materials which aggregate materials are incorporated into the binding agent matrix (2), the plate being produced according to the following steps:

a) preparing a mixture having a composition comprising the aggregate materials and the at least one, permanent inorganic binding agent, b) filling the mixture into a mold, c) compacting the mixture by means of uniaxial pressing to form a "green" plate, d) removing the "green" plate from the mold, and e) letting the "green" plate set to form the plate (1), wherein the aggregate materials comprise at least 60 wt. % of aggregate grains of biogenic silicic acid, relative to the total dry mass of the aggregate materials, wherein the plate comprises a cold flexural strength from 1.0 to 9.0 MPa according to DIN EN 993-6: 1995-04, wherein the plate comprises a softening point from 1200 to 1650° C., determined with a hot stage microscope according to DIN EN 51730: 2007-09; and using the plate to cover molten steel and/or an ingot (14) solidifying from the molten steel;

wherein the plate provides for the thermal isolation of the molten steel and/or of the ingot (14).

2. The method according to claim 1, characterized in that the plate (1) is used for thermal isolation of the molten steel and/or of the ingot (14) in rising ingot casting.

3. The method according to claim 2, characterized in that the plate (1) is used for thermal isolation of an ingot head (15) of the ingot (14).

4. The method according to claim 1, characterized in that the plate (1) is used for thermal isolation of the molten steel, located in a metallurgical vessel, and/or of the ingot (14) located in a metallurgical vessel, from the vessel itself and/or from the atmosphere.

5. The method according to claim 1, characterized in that the plate (1) covers and provides for the thermal isolation of a steel bath, located in an ingot mold (7).

6. The method according to claim 1, characterized in that the plate (1) covers and provides for the thermal isolation of a steel bath (8), located in a casting distributor (20).

7. The method according to claim 1, characterized in that the aggregate grains of biogenic silicic acid are rice husk ash, diatomaceous earth, siliceous rock, diagenetic radiolarian taxa solidified into stone, sponges made of opal, or mixtures thereof.

8. The method according to claim 1, characterized in that the aggregate materials consist of at least 80 wt. % aggregate grains of biogenic silicic acid, relative to the total dry mass of the aggregate materials.

9. A method of providing thermal isolation of a refractory lining, the method comprises:

providing an unfired, refractory molded body (1) wherein the molded body includes a binding agent matrix (2) containing at least one set, permanent inorganic binding agent and aggregate materials which are incorporated into the binding agent matrix (2), the molded body being produced according to the following steps:

a) Preparing a mixture having a composition comprising the aggregate materials and the at least one, permanent inorganic binding agent, b) Filling the mixture into a mold, c) Compacting the mixture by means of uniaxial pressing to form a "green" molded body, d) Removing the "green" molded body from the mold, and e) Letting the "green" molded body set to form the molded body (1), wherein the aggregate materials comprise at least 60 wt. % of aggregate grains of biogenic silicic acid, relative to the total dry mass of the aggregate materials, wherein the molded body comprises a cold flexural strength from 1.0 to 9.0 MPa according to DIN EN 993-6:1995-04, wherein the molded body comprises a softening point from 1200 to 1650° C., determined with a hot stage microscope according to DIN EN 51730:2007-09; and utilizing the unfired, refractory molded body (1) to thermally isolate the refractory lining in a multiple-layer brick wall or in a heat-treatment furnace.

10. The method according to claim 9, characterized in that the molded body (1) comprises a dry apparent density $p_0$ from 0.3 to 1.5 g/cm$^3$ according to DIN EN 1094-4:1995-09.

11. The method according to claim 9, characterized in that the molded body (1) comprises a porosity from 60 to 90% according to DIN EN 1094-4: 1995-09.

12. The method according to claim 9, characterized in that the molded body (1) comprises a cold compression strength from 1.5 to 20.0 MPa according to DIN EN 993-5:1998-12.

13. The method according to claim 9, characterized in that the molded body (1) comprises a hot flexural strength from 1.5 to 7.0 MPa according to DIN EN 993-7:1995-04.

14. The method according to claim 9, characterized in that the molded body (1) comprises the following thermal conductivities (WLF) according to DIN EN 993-15:2005-07.

| | WLF [W/mK] |
|---|---|
| at 26° C. | 0.10 to 0.14 |
| at 307° C. | 0.12 to 0.16 |
| at 700° C. | 0.17 to 0.21 |
| at 995° C. | 0.25 to 0.29. |

15. The method according to claim 9, wherein the method further comprises vibrating the mixture for 30 seconds and adjusting the composition of the mixture such that the mixture has a slump of 200 to 500 mm, determined in reference to DIN EN ISO 1927-4:2013-03.

16. The method according to claim 9, characterized in that the composition of the mixture comprises the following amount of individual constituents relative to the total dry mass of the mixture, wherein the individual constituents add up to 100 wt. %:

| | Amount [wt. %] |
|---|---|
| Aggregate grains of Biogenic silicic acid | 20.0 to 95.0 |
| Permanent binding agent | 5.0 to 30.0 |
| Other aggregate materials | 0 to 20.0 |
| Other constituents | 0 to 30.0. |

17. The method according to claim 5, characterized in that the plate (1) covers and provides for the thermal isolation of the steel bath, located in the ingot mold (7) in falling or rising ingot casting.

18. The method according to claim 9, characterized in that the aggregate grains of biogenic silicic acid are rice husk ash, diatomaceous earth, siliceous rock, diagenetic radiolarian taxa solidified into stone, sponges made of opal, or mixtures thereof.

19. The method according to claim 9, characterized in that the aggregate grains of biogenic silicic acid consist of rice husk ash.

20. The method according to claim 9, characterized in that the aggregate materials consist of at least 80 wt. % aggregate grains of biogenic silicic acid, relative to the total dry mass of the aggregate materials.

21. The method according to claim 20, characterized in that the at least 80 wt. % aggregate grains of biogenic silicic acid consist of rice husk ash.

22. The method according to claim 9, characterized in that the aggregate materials consist of 100 wt. % aggregate grains of biogenic silicic acid, relative to the total dry mass of the aggregate materials.

23. The method according to claim 20 characterized in that the 100 wt. % aggregate grains of biogenic silicic acid consists of rice husk ash.

24. The method according to claim 9, wherein the at least one set, permanent inorganic binding agent comprises a water-glass binder, a sol-gel binder, a phosphate binder, alumina cement, Portland cement, or a mixture thereof.

* * * * *